US006739172B2

(12) United States Patent
Wagner

(10) Patent No.: US 6,739,172 B2
(45) Date of Patent: May 25, 2004

(54) PRESSING TONGS

(75) Inventor: Rudolf Wagner, Stuttgart (DE)

(73) Assignee: Rems-Werk Christian Föll und Söhne GmbH & Co., Waiblingen (DE)

( * ) Notice: Subject to any disclaimer, the term of this patent is extended or adjusted under 35 U.S.C. 154(b) by 0 days.

(21) Appl. No.: 10/047,281

(22) Filed: Jan. 14, 2002

(65) Prior Publication Data

US 2002/0092336 A1 Jul. 18, 2002

(30) Foreign Application Priority Data

Jan. 15, 2001 (DE) ..... 101 01 440

(51) Int. Cl.[7] ..... B21D 39/04; B25B 7/00

(52) U.S. Cl. ..... 72/409.01; 72/407; 72/416; 72/453.16

(58) Field of Search ..... 72/409.16, 409.01, 72/416, 413, 453.16, 453.15; 30/228, 191, 192, 193; 81/427.5, 342, 345, 383.5, 301

(56) References Cited

U.S. PATENT DOCUMENTS

| | | | | | |
|---|---|---|---|---|---|
| 1,146,951 | A | * | 7/1915 | Porter | 30/193 |
| 2,411,838 | A | * | 11/1946 | Swengel | 72/409.14 |
| 2,693,218 | A | * | 11/1954 | Klein | 72/407 |
| 2,939,211 | A | * | 6/1960 | Freedom | 30/187 |
| 3,742,957 | A | * | 7/1973 | White | 81/342 |
| 3,903,725 | A | * | 9/1975 | Rommel | 72/409.09 |
| 4,505,038 | A | * | 3/1985 | Porter | 30/193 |
| 5,758,729 | A | * | 6/1998 | Undin | 30/228 |
| 5,862,597 | A | * | 1/1999 | Juros | 30/191 |
| 6,230,542 | B1 | * | 5/2001 | Frenken | 72/409.16 |

* cited by examiner

*Primary Examiner*—Daniel C. Crane
(74) *Attorney, Agent, or Firm*—Gudrun E. Huckett

(57) ABSTRACT

Pressing tongs have at least two pressing jaws wherein at least one of the pressing jaws is configured to be moved from a closed position into an open position. At least one first connector is provided to connect the pressing tongs to a motor-driven actuating device. At least one second connector is provided to connect the pressing tongs to a manual actuating device. The same type of pressing tongs can thus be operated manually as well as motor-driven.

38 Claims, 6 Drawing Sheets

PRESSING TONGS

BACKGROUND OF THE INVENTION

1. Field of the Invention

The invention relates to pressing tongs comprising at least two pressing jaws of which at least one is adjustable from a closed position into an open position and further comprising at least one connector providing a connection to a motor-driven actuating device.

2. Description of the Related Art

Pressing tongs are used primarily for sanitary installations in order to connect two pipes or pipe sections to one another by means of connecting members, so-called fittings. For this purpose, the connecting members are slipped over the ends of two pipes and are then plastically deformed in order to achieve a fixed connection between the two pipes by means of the connecting member. The pressing tongs have two pressing jaws for this purpose with machined system-specific pressing contours, respectively. In order to actuate the pressing jaws and, in particular, to exert the pressing force, the pressing tongs are connected by a connector to a motor-driven actuating device having an axially movable plunger. Such actuating devices operate electro-mechanically or electro-hydraulically. The plunger supports pressing rolls with which, upon extension of the plunger, the pressing tongs are closed and the pressing force is exerted.

Manually operated pressing devices in the form of pipe tongs are also known wherein the respective pressing contour is provided as a unitary part of the device. Accordingly, separate pipe tongs are required for each pipe size. Exchangeable inserts which have the respective pressing contour and can be inserted into the pressing tongs are also known. It is then possible to employ the pressing tongs for a limited diameter range of pipes, respectively, corresponding connecting members to be press-jointed.

Finally, actuating devices are known which are comprised of two levers articulated with one another by means of which the pressing jaws can be directly opened or closed. In comparison to the pressing tongs for the motor-driven actuating devices, these pressing tongs are configured differently. The operator of the pressing tongs therefore needs separate sets of pressing tongs for the use of the manual and the motor-driven actuating devices.

SUMMARY OF THE INVENTION

It is an object of the present invention to configure the pressing tongs of the aforementioned kind such that they can be used cost-effectively for different press-jointing tasks.

In accordance with the present invention, this is achieved in that the pressing tongs have at least one additional connector for a manual actuating device.

The pressing tongs according to the invention can be connected by a first connector in a conventional way to the motor-driven actuating device. However, when the operator desires to actuate the pressing tongs by means of the manual actuating device, the pressing tongs according to the invention can be connected by the additional connector without problem to such an actuating device. The operator of the pressing tongs according to the invention is therefore not required to acquire different pressing tongs with a system-specific pressing contour or pressing tools with exchangeable inserts or different pipe pressing tongs to match the different types of actuating devices.

DESCRIPTION OF THE PREFERRED EMBODIMENTS

By means of the pressing tongs or pressing tools described in the following connecting members which are slipped onto pipes to be connected with one another are plastically deformed. The pressing tongs are used primarily in the field of sanitary and heating technology. The connecting members to be deformed can be of metal and/or of plastic material. As a result of the plastic deformation, the pipes to be connected with one another and the connecting member are safely connected with one another. Since this pressing technology is well-known in the art, it will not be explained in more detail in the following.

Figure 2:
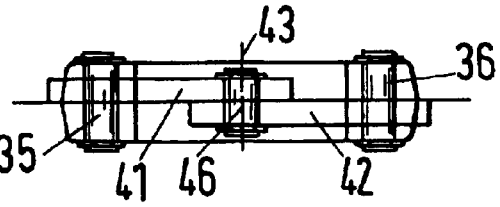
FIG. 2 is a schematic illustration of a view in the direction of arrow II of FIG. 1.
Figure 1:
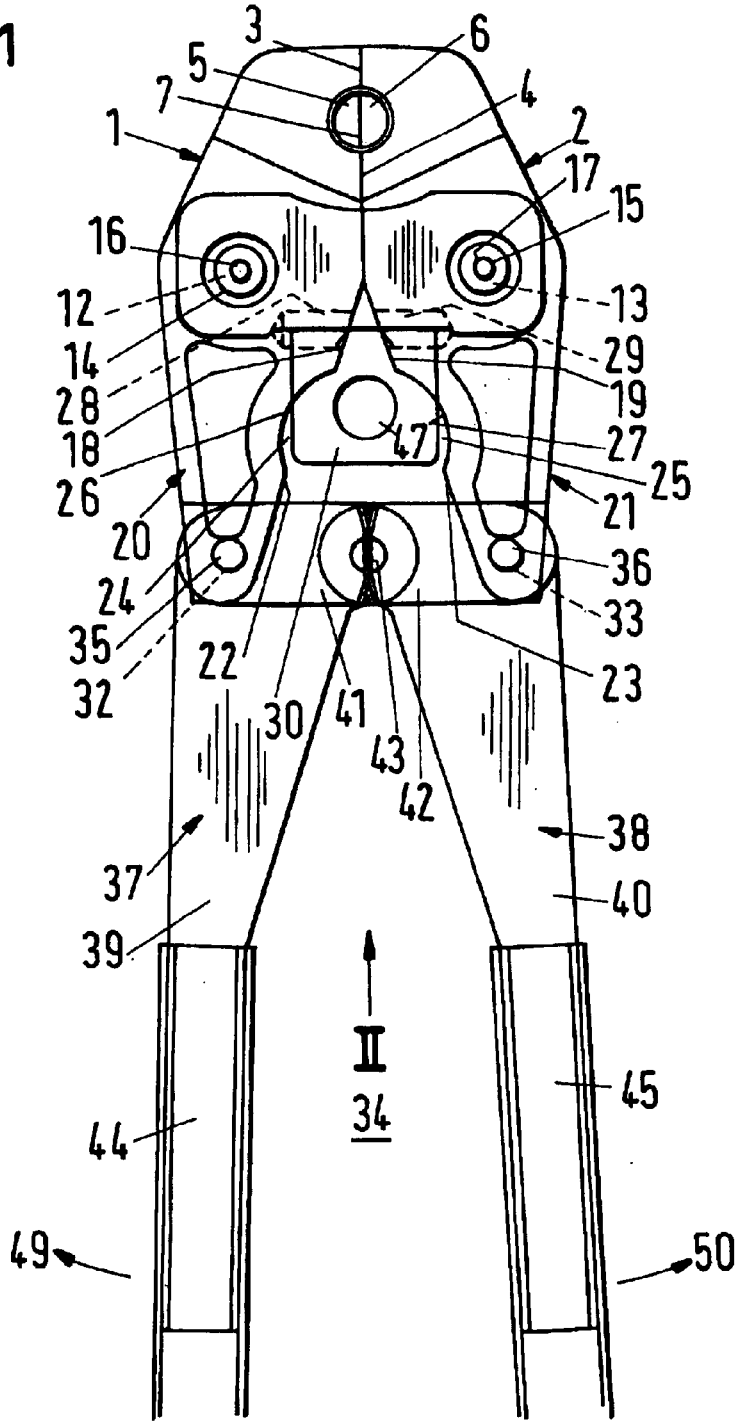
FIG. 1 is a front view of pressing tongs according to the invention connected to a manual actuating device.
Figure 3:
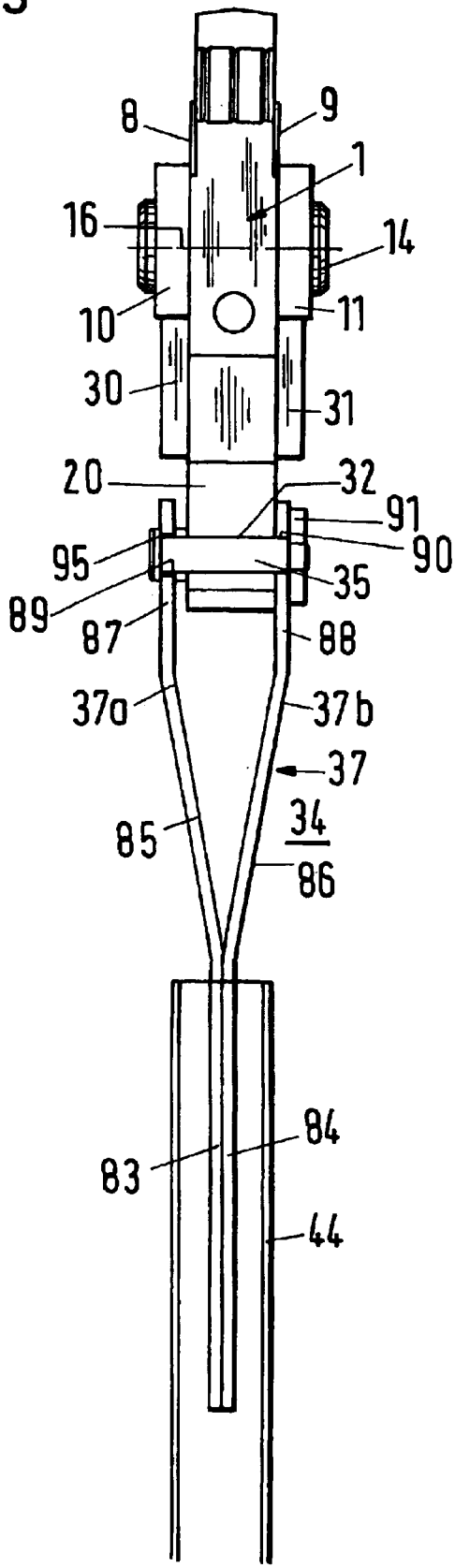
FIG. 3 is a the side view of a second embodiment of pressing tongs according to the invention connected to a manual actuating device.
Figure 4:
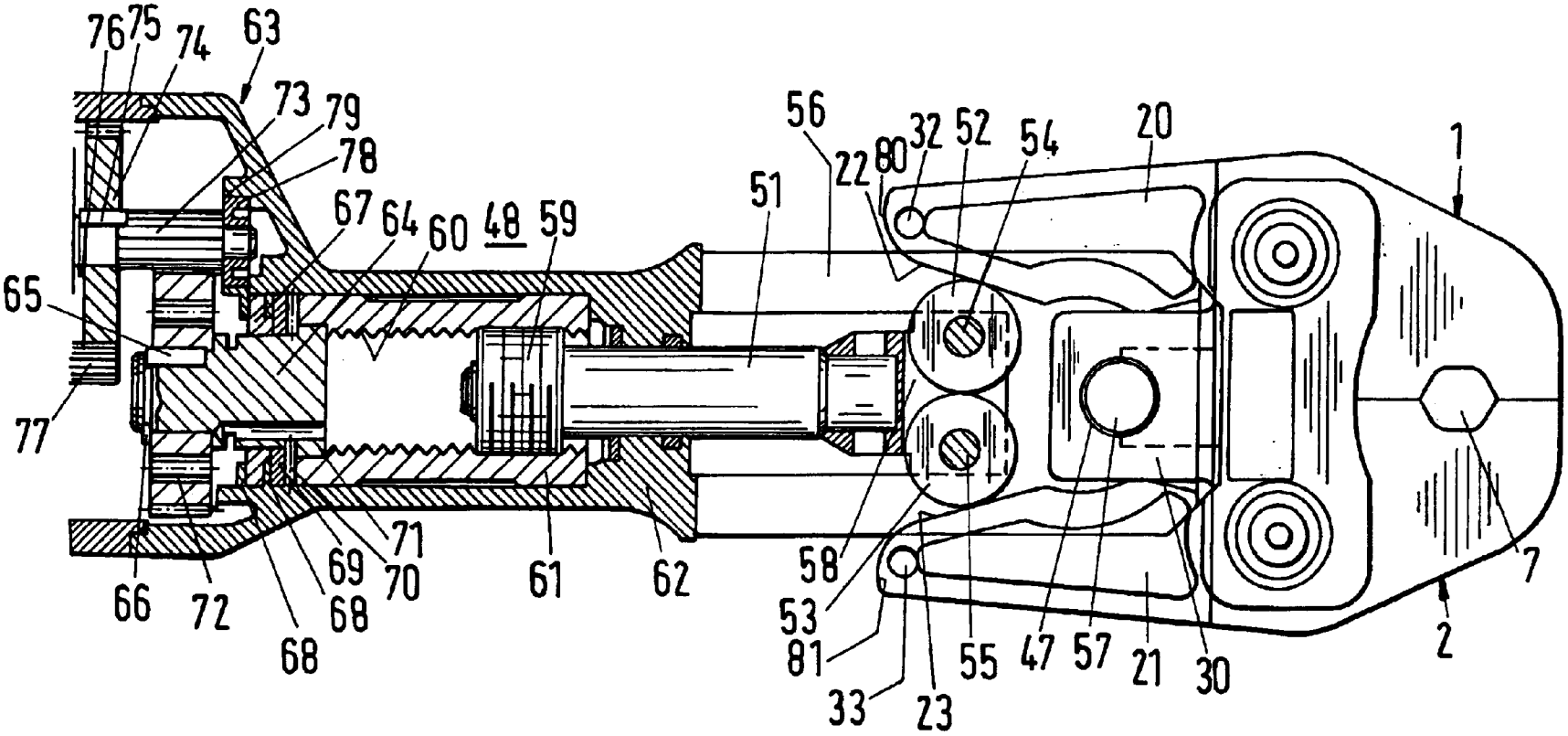
FIG. 4 shows the pressing tongs according to FIG. 1 connected to a motor-driven actuating device.

The pressing tongs can be operated manually or by means of a motor drive. FIGS. 1 through 3 show the pressing tongs for a manual actuation; FIG. 4 shows the same pressing tongs for a motor-driven actuation. The plumber or operator can accordingly employ the pressing tongs as desired by manual drive or motor drive. It is not necessary to have different pressing tongs for the different types of drive action.

The pressing tongs according to FIGS. 1 and 2 are provided with two oppositely pivotable pressing jaws 1, 2 which in FIG. 1 are illustrated in the closed position in which their plane end faces 3, 4 rest against one another. The end faces 3, 4 are provided with semi-circular recesses 5, 6 which together form a circular receptacle 7 when the pressing jaws 1, 2 are in the closed position for receiving the part to be press-jointed (not illustrated).

The two pressing jaws 1, 2 are arranged mirror-symmetrically relative to one another and have the same thickness. Connecting straps 10, 11 rest against the oppositely positioned outer sides 8, 9 (FIG. 3), respectively. As illustrated in FIG. 1, they extend perpendicularly to the longitudinal center plane of the pressing tongs and are provided proximal to their ends with through openings 12, 13, respectively, for bolts 14, 15 which also penetrate the pressing jaws 1, 2 positioned between the two connecting straps 10, 11. The connecting straps 10, 11 and the pressing jaws 1, 2 are axially secured on the bolts 14, 15 in a way known in the art. The axes 16, 17 of the bolts 14, 15 provide pivot axes for the two pressing jaws 1, 2.

The end faces 3, 4 of the two pressing jaws 1, 2 have an obtuse angle transition into slanted surfaces 18, 19. In the open position (FIG. 6), the slanted surfaces 18, 19 of the pressing jaws 1, 2 rest against one another areally. The slanted surfaces 18, 19 are shorter than the plane end faces 3, 4. The transition between the slanted surfaces 18, 19 and end faces 3, 4 is located at the level of the connecting straps 10, 11. The slanted surfaces 18, 19 project past the connecting straps 10, 11 (FIG. 1).

The two pressing jaws 1, 2 advantageously have arms 20, 21 formed as monolithic parts thereof. The arms 20, 21 taper with respect to their width in a direction toward their free end. Advantageously, the arms 20, 21 have the same width as the pressing jaws 1, 2.

The arms 20, 21 have facing slanted surfaces 22, 23 which, in the closed position of the pressing jaws 1, 2 according to FIG. 1, diverge in the direction toward the free end of the arms. In the illustrated embodiment, the slanted surfaces 22, 23 are planar and begin at the free ends of the arms 20, 21. At a spacing from the slanted surfaces 18, 19, the slanted surfaces 22, 23 have a transition into a part-circular recess 24, 25, respectively. The curved bottom 26, 27 of the recesses 24, 25 connects the slanted surfaces 22, 23 with the slanted surfaces 18, 19.

The arms 20, 21 are loaded by at least one pressure spring (not illustrated) which engages a blind bore 28, 29, respectively, in the facing slanted surfaces 18, 19 of the two arms 20, 21. This pressure spring ensures that the pressing jaws 1, 2, when they are not connected to an actuating device, are pivoted into the closed position. In the closed position according to FIG. 1, the two blind bores 28, 29 are aligned with one another. Their axes in the closed position of the pressing jaws 1, 2 extend perpendicularly to the end faces 3, 4 of the pressing jaws 1, 2 resting against one another.

A rectangular strap member 30, 31 adjoins centrally the lower edge of the two connecting straps 10, 11, respectively. In the illustrated embodiment, the strap members 30, 31 are slightly thinner than the corresponding connecting straps 10, 11 (FIG. 3) and are formed as a monolithic part thereof. The connecting straps 10, 11 and the strap members 30, 31, of course, can have the same thickness. Of course, it is also possible to form the strap members 30, 31 thicker than the connecting straps 10, 11.

The arms 20, 21 of the pressing jaws 1, 2 are provided with a connector or receptacle 32, 33 (FIG. 1), respectively, in order to be able to connect the pressing jaws 1, 2 to a manual actuating device 34. The receptacles 32, 33 are formed by openings penetrating the arms 20, 21 into which bolts 35, 36 can be inserted. The two lever arms 37, 38 of the actuating device 34 are connected to the arms 20, 21 by means of the bolts 35, 36. The two levers 37, 38 are L-shaped, respectively. The two long legs 39, 40 of the two levers 37, 38 are significantly longer than the short legs 41, 42 of the levers 37, 38. The short legs 41, 42 extend perpendicularly to the long legs 39, 40. The free ends of the two short legs 41, 42 are articulated to one another. The elbow lever axis or articulation axis 43 formed in this way is positioned centrally between the two arms 20, 21 when the pressing jaws 1, 2 are closed. Moreover, the elbow lever axis 43 is positioned in a common plane with end faces 3, 4 of the pressing jaws 1, 2 resting against one another. In the closed position of the pressing jaws 1, 2, this plane is perpendicularly positioned relative to a plane in which the axes of the bolts 35, 36 are positioned. As illustrated in FIG. 1, the elbow lever axis 43 is located approximately at the level of the free ends of the arms 20, 21 of the pressing jaws 1, 2 above a straight line connecting the two axes of the receptacles 32, 33.

The long legs 39, 40 of the two levers 37, 38 taper away from the short legs 41, 42 (FIG. 1). At a spacing from the elbow lever axis 43, the two long legs 39, 40 have the same width or the same cross-section. In this area the two levers 37, 38 are received in pipes or pipe sections 44, 45, forming grip members, and secured therein in a suitable way.

The bolt 46 (FIG. 2) forming the elbow lever axis 43 penetrates the two short legs 41, 42 whose free ends overlap one another and rest against one another (FIG. 2). As illustrated in FIG. 2, the two short legs 41, 42 of the two levers 37, 38 are located within the width of the pressing jaws 1, 2.

The two bolts 35, 36 by which the actuating device 34 is articulated on the pressing jaws 1, 2, can be easily released so that the mechanical actuating device 34, if needed, can be simply detached from the pressing tongs. The two short legs 41, 42 and the elbow lever axis 43 are positioned at a spacing from the strap members 30, 31 so that the pressing jaws 1, 2 can be pivoted by the required amount without being impaired by the strap members 30, 31.

The strap members 30, 31 have a through opening 47 centrally arranged thereat, respectively, which forms a connector or receptacle for the connection of the pressing tongs to a motor-driven actuating device 48 (FIG. 4).

Figure 5:
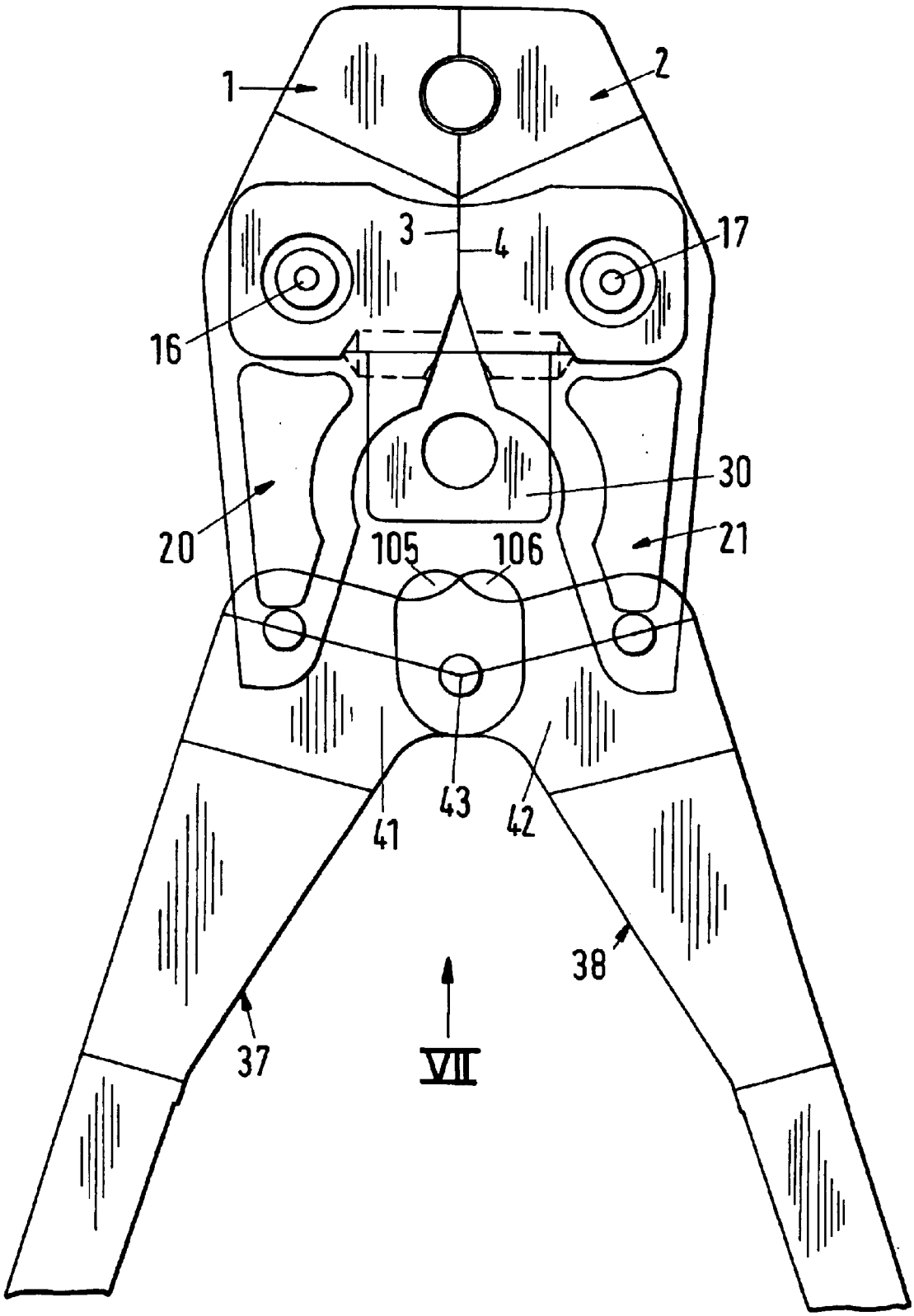
FIG. 5 shows the pressing tongs according to FIG. 1, whose pressing jaws are closed, in an intermediate position of the actuating levers of the manual actuating device.

In order to be able to attach by press-jointing a connecting member (fitting) onto a corresponding pipe, the two levers 37, 38 are pivoted about the elbow lever axis 43 relative to one another in opposite directions, as indicated by arrows 49, 50 in FIG. 1. When doing so, the two arms 20, 21 are pivoted toward one another (FIG. 6) as a result of their articulation on the levers 37, 38 by means of the bolts 35, 36. FIG. 5 shows an intermediate position of the two levers 37, 38 during pivoting from the initial position according to FIG. 1. In the initial position, the two short legs 41, 42 are pivoted slightly past their relative parallel position about the elbow lever axis 43 so that the elbow levers 37, 38 are slightly moved past their aligned position. This ensures that the two pressing jaws 1, 2 rest with their end faces 3, 4 against one another with great force. In turn, this ensures that a connecting member positioned in the receptacle opening 7 is plastically deformed by a sufficient amount.

Figure 6:
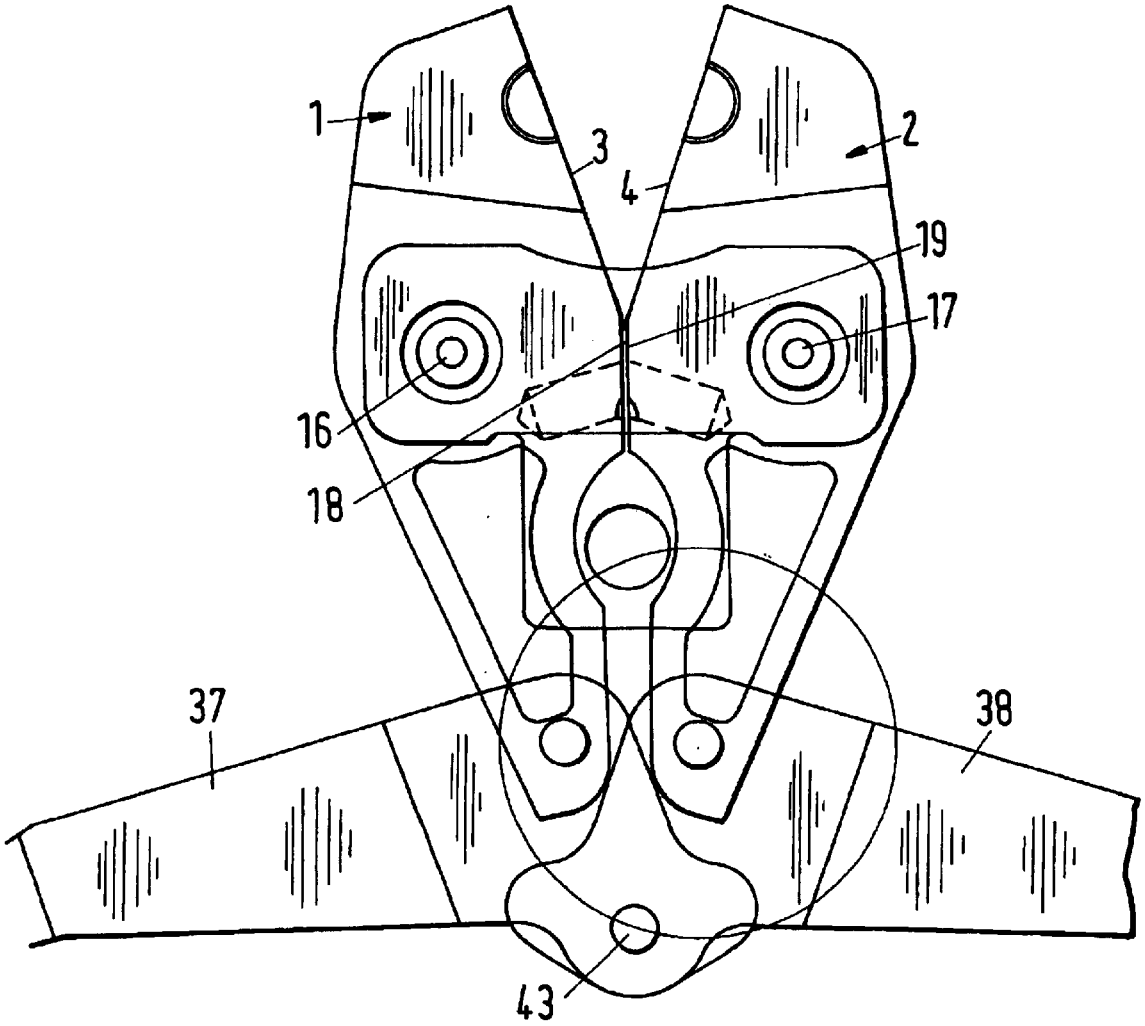
FIG. 6 shows the pressing tongs according to FIG. 5 in the open state.

When pivoting the levers 37, 38 about the elbow lever axis 43, the short legs 41, 42 pivot slightly toward one another without the two pressing jaws 1, 2 being pivoted relative to one another (FIG. 5). In this position, the two pressing jaws 1, 2 are relieved so that their end faces 3,4 rest against one another only with very slight pressure. When the two levers 37, 38 are pivoted farther in the direction of arrows 49, 50 (FIG. 1) about the elbow lever axis 43, the arms 20, 21 of the pressing jaws 1, 2 are pivoted toward one another about the bolt axes 16, 17 so that the end faces 3, 4 of the pressing jaws 1, 2 are lifted off one another (FIG. 6). The pressing jaws 1, 2 can be pivoted away from one another maximally to such an extent until their slanted surfaces 18, 19 rest against one another. The pressing jaws 1, 2 are then pivoted away from one another such that the part to be pressed can be easily positioned between the two pressing jaws 1, 2. With the pressing jaws 1, 2 being open, the pressing tongs can also be placed onto the part to be pressed. Subsequently, the two levers 37, 38 are pivoted in a direction counter to the arrows 49, 50 toward one another about the elbow lever axis 43. This has the result that the arms 20, 21 of the pressing jaws 1, 2 articulated by the bolts 35, 36 are pivoted away from one another. Correspondingly, the pressing jaws 1, 2 pivot about the axes 16, 17 of the bolts 14, 15. As soon as the end faces 3, 4 of the pressing jaws 1, 2 rests against one another (FIG. 5), the further pivoting action of the levers 37, 38 out of the position according to FIG. 5 into the position according to FIG. 1 causes the required pressing force to be exerted in order to press-joint in this way the part positioned in the receptacle opening 7 by the required amount. As a result of the lever ratio, this pressing force can be applied by the operator without problem. The levers 37, 38 are multiple times longer than the pressing jaws 1, 2. Since the short legs 41, 42 of the levers 37, 38 advantageously are pressed past their aligned position, the levers 37, 38, when released by the operator, will not return from the position according to FIG. 1. In the overextended position of the short legs 41, 42 the elbow lever axis 43 is positioned at a small spacing from the plane containing the axes of the bolts 35, 36 on that side of the plane which is facing the bolts 14, 15.

The legs 39, 40 of the levers 37, 38 widen in a direction away from the pipes 44, 45 toward the short legs 41, 42 (FIG. 1). With this measure, the levers 37, 38 have a satisfactory strength.

As illustrated in FIG. 2, at least the short lever arms or legs 41, 42 are formed as flat members. In the area of the bolt 46, whose axis is formed by the elbow lever axis 43, the short legs 41, 42 thus rest areally against one another so that the levers 37, 38 can be reliably pivoted. Advantageously, the two levers 37, 38 are formed in their entirety as flat members or sheet metal parts so that they can be manufactured by stamping in a simple and inexpensive way. The pipes or pipe sections 44, 45 can be provided in the grip area advantageously with profiled portions or the like so that the operator can safely hold the pressing device. Of course, the pipes or pipe sections 44, 45 can also be without such profiling. The pipes or pipe sections can be round, non-circular or have a polygonal cross-section and advantageously be comprised of a metallic material. Moreover, the pipe sections or pipes 44, 45 can also be formed of a hard plastic material.

The pressing jaws 1, 2 can also be actuated by means of a motor-driven actuating device 48 according to FIG. 5. For this purpose, it is only necessary to detach the two bolts 35, 36 so that the two pressing jaws 1, 2 are released from the manual actuating device 34. Subsequently, the pressing jaws 1, 2 are connected to the actuating device 48. The actuating device 48 is provided with a plunger 51 which is movable in the axial direction and has at its free end at least two pressing rolls 52, 53 which are connected so as to be freewheeling. They can freewheel about axes 54, 55 positioned perpendicularly to the plunger axis. Advantageously, they rest against one another.

The actuating device 48 has two projecting connecting arms 56, wherein only one of the connecting arms is illustrated in FIG. 4. By means of a connecting element in the form of a socket pin 57, the pressing tongs are connected with the connecting arms 56. The socket pin 57 is inserted into openings in the connecting arms 56 as well as into through openings 47 in the strap members 30, 31 of the pressing tongs and axially secured in a suitable way. In this way, the pressing tongs are rigidly connected with the actuating device 48. The plunger 51 with the pressing rolls 52, 53 is axially movable in the area between the connecting arms 56. FIG. 4 shows the position in which the pressing rolls 52, 53, in an initial position in which the pressing jaws 1, 2 are closed, rest against the slanted surfaces 22, 23 of the arms 20, 21 of the pressing jaws 1, 2. The axes of rotation 54, 55 of the pressing rolls 52, 53 are supported on a fork member 58 which is provided at the free end of the plunger 51. The opposite end of the plunger 51 is provided with a spindle nut 59 which engages an inner thread 60 of a spindle bushing 61. The bushing 61 is rotatably supported in a tubular projection 62 of a housing 63 of the actuating device 48 and is seated fixedly on a shaft end 64 on which a gear 66 is secured by means of a key 65. A radially outwardly oriented flange member 67 is seated on the shaft end 64 and is axially secured between two retaining washers 68. Accordingly, the shaft end 64 is axially secured in the housing 63.

A disk 69 is seated on the shaft end 64 adjacent to the flange member 67 and is axially supported on a roller bearing 70. The end of the shaft end 64 facing the plunger 51 has a radially outwardly oriented flange 71 which is surrounded by the free end of the spindle bushings 61. The roller bearing 70 rests against the free end of the spindle bushings 61 as well as against the flange 71.

The gear 66 is axially penetrated by at least one bore 72 and meshes with an intermediate pinion 73 which is positioned axis-parallel to the shaft end 64 and supports a gear 74 which is fixedly connected by means of a key 75 on the intermediate pinion 73. The gear 74 is axially secured by a retaining ring 76 on the intermediate pinion 73.

The gear 74 has approximately the same diameter as the gear 66 and engages a pinion 77 which is seated on a drive shaft (not illustrated) of the actuating device 48.

The intermediate pinion 73 is rotatably supported by means of a bearing 78, preferably a rolling bearing, in a cylindrical projection 79 on the inner side of the housing 63.

The actuating device 48 has a drive motor, preferably an electric motor, having at least two gear stages 74, 77 and 66, 73. Depending on the desired gear reduction, the motor can have a multi-stage reduction gear with more than two gear stages.

In order to be able to open the pressing jaws 1, 2 when they are in the closed position illustrated in FIG. 4, the drive motor of the actuating device 48 is switched on. By means of gear stages 74, 77; 66, 73, the shaft end 64 and thus the spindle bushing 61 are driven in rotation. By doing so, the spindle nut 59 is axially moved within the spindle bushing 61. The rotational direction of the drive motor is selected such that the plunger 51 moves axially to the left in FIG. 4. The pressing rolls 52, 53 are thus released from the arms 20, 21. The pressure spring, which engages with its ends the blind bores 28, 29 (FIG. 1), maintains the pressing jaws 1, 2 in the closed position via the arms 20, 21. For opening, the arms 20, 21 are pressed together after retraction of the plunger 51 so that the pressing jaws 1, 2 are opened, as has been explained in connection with FIGS. 5 and 6. The maximum opening of the pressing jaws 1, 2 is achieved when they rest with their slanted surfaces 18, 19 against one another (FIG. 6).

The part to be pressed can now be positioned easily between the pressing jaws 1, 2 or the pressing tongs can be easily placed onto the part to be pressed. Subsequently, the pressing jaws 1, 2 are returned under the force of the pressure spring to the point of contact on the inserted part to be pressed as soon as the arms 20, 21 are again released.

The operator of the pressing device must now reverse the drive motor so that the shaft end 64 with the spindle bushing 61 will rotate in the reverse direction. Thus, the plunger 51 with the pressing rolls 52, 53 will be moved out of the projection 62 of the housing 63. The pressing rolls 52, 53 run in the area of the rounded end faces 80, 81 onto the slanted surfaces 22, 23 of the arms 20, 21 and force them apart. As soon as the end position according to FIG. 4 has been reached, the part positioned in the receptacle opening 7 between the pressing jaws 1, 2 has been plastically deformed by a sufficient amount.

For removing the pressed part, the drive motor of the actuating device 48 is again reversed so that the plunger 51 and the pressing rolls 52, 53 are retracted and the pressing jaws 1, 2 are opened in the way described above.

The pressing tongs can be connected in the described way as desired to the actuating device 34 or the actuating device 48 because they are provided with corresponding connectors 32, 33 and 47. Via the connectors 32, 33 the levers 37, 38 of the actuating device 34 can be connected. The additional connector 47 is formed by the insertion openings for the socket pin 57 in the strap members 30, 31. The operator, without constructive changes on the pressing tongs being required, can thus operate the pressing tongs as desired manually or motor-driven. The operator does not need different sets of pressing tongs for manual operation and for the motor-driven actuation but can use the same pressing tongs for manual as well as motor-driven operation.

FIG. 3 shows a further embodiment of the actuating device 34 with which the two pressing jaws 1, 2 can be manually actuated. In contrast to the embodiment according to FIGS. 1 and 2, the levers 37, 38 are formed by twin levers 37*a*, 37*b*; 38*a*, 38*b*. They have plane and flat end members 83, 84 which rests against one another and are fastened in the pipe or pipe member 44. These flat end members 83, 84 have a transition outside of the pipe 44 into diverging slanted portions 85, 86 which then pass over into parallel end portions 87, 88. They are positioned on opposite sides of the arms 20, 21 of the pressing jaws 1, 2 and are connected to one another by bolts 35, 36 which extend through the insertion openings 32, 33 in the arms 20, 21 and the insertion openings 89, 90 in the end portions 87, 88 of the levers 37, 38.

FIG. 3 shows the actuating device 34 in a side view showing only twin levers 37*a*, 37*b*. When viewed in a front view, the twin levers 37*a*, 37*b* are of identical configuration as in the embodiment according to FIGS. 1 and 2. Since the twin levers 37*a*, 37*b*; 38*a*, 38*b* of the levers 37, 38 are positioned on both sides of the arms 20, 21 of the pressing jaws 1, 2, an optimal central force introduction through the two twin levers onto the pressing jaws 1, 2 is ensured. The bolts 35, 36 can be, according to the embodiment of FIGS. 1 and 2, simple socket pins which make possible to simple attachment of the actuating device on the pressing jaws 1, 2 of the pressing tongs. The twin levers 37*a*, 37*b*; 38*a*, 38*b* are advantageously sheet metal parts as illustrated in the embodiment of FIGS. 1 and 2 which can be manufactured simply and inexpensively.

The end portions 87, 88 of the levers 37*a*, 37*b* are arranged on the pressing tongs such that, viewed in the longitudinal direction of the pressing tongs, they do not project laterally past the strap members 30, 31 or the connecting straps 10, 11.

The levers of the embodiment according to FIGS. 1 through 3 can also have a slotted cast head or forged head which receives the free ends of the arms 20, 21 of the pressing jaws 1, 2 which are articulated therein in the described way.

Figure 7:
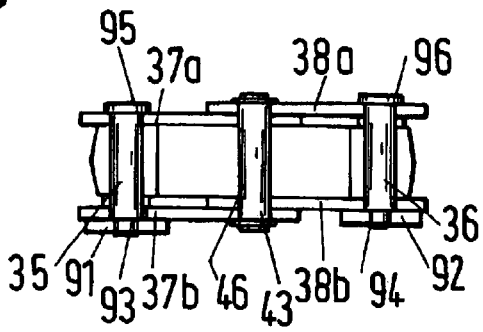
FIG. 7 is a schematic illustration of a view in the direction of arrow VII of FIG. 5.

As illustrated in FIG. 7, the short legs of the L-shaped twin levers 37*a*, 37*b* and 38*a*, 38*b* are connected to one another by the bolt 46 whose axis 43 forms the elbow lever axis. In order to enable the use of bolts 35, 36 in the form of threaded bolts even for very thin twin levers 37*a*, 37*b*; 38*a*, 38*b*, it is advantageous to employ for the purpose of threading the threaded bolts disks or washers 91, 92 (FIGS. 3 and 7) which rests against the outer side of the twin levers 37*b* and 38*b*, respectively, and are provided with a threaded bore 93, 94 for the corresponding threaded portions of the threaded bolts 35, 36, respectively. In the mounted position, the bolts 35, 36 rest with their head 95, 96 on the outer sides of the levers 37*a*, 38*a*.

The bolts 35, 36 can also be secured in a different way, for example, by split pins, securing washers and the like so that a simple and fast exchange is possible.

Figure 8:
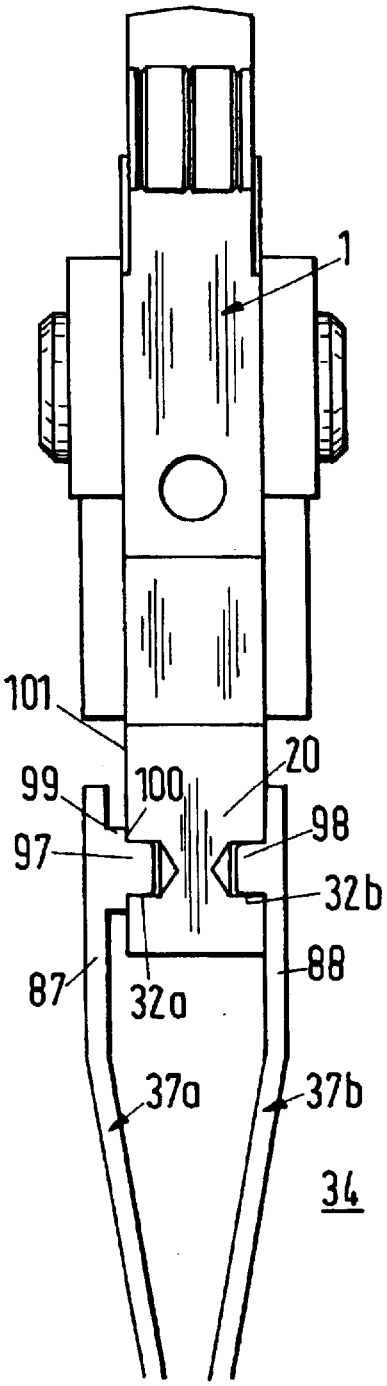
FIG. 8 is a side view of a third embodiment of the pressing tongs according to the invention.

FIG. 8 shows a further possibility of connecting the pressing tongs to the manual actuating device 34. It comprises again twin levers; FIG. 8 illustrates only the twin levers 37*a*, 37*b*. Their free end portions 87, 88 are provided with coupling members in the form of oppositely oriented projections 97, 98 which engage receptacles in the form of depressions 32*a*, 32*b* of the arms 20 of the pressing jaws. In contrast to the preceding embodiments, the receptacles 32*a*, 32*b* are depressions in which the projections 97, 98 engage in a positive-locking way. At least one of the twin levers, preferably both twin levers 37*a*, 37*b*, are configured to be bendable or flexible such that the actuating device 34 can be connected in a simple way with the pressing tongs. It is possible to configure the twin levers 37*a*, 37*b* so as to be yielding or to provide a hinge or joint in the end area. For example, the projections 97, 98 can also be plug parts which are first retracted and then pushed back into the receptacles 32*a*, 32*b* for connecting the actuating device 34 to the pressing tongs. The projections 97, 98 in this case can be formed, for example, like a springy locking bolt.

Since the short legs of the twin levers 37*a*, 37*b* overlap one another, as illustrated in FIGS. 1, 2, 5, 6, and 7, on one twin lever 37*a*, on the side facing the oppositely positioned twin lever 37*b*, a projecting member 99 is provided from which a projection 97 extends away in a central area. The twin lever 37*a* rests with the end face 100 of the projecting member 99 on the corresponding lateral surface of the arm 20 of the pressing jaw. Accordingly, the end portion 87 has such a spacing from the lateral surface 101 of the arm 20 that the short leg of the other twin lever (not illustrated) can engage this interstitial space.

In this embodiment, the levers 37*a*, 37*b* also engage both sides of the pressing jaws 1, 2 so that a central force introduction via the twin levers onto the pressing jaws is realized. Accordingly, the elbow lever axis 43 (not illustrated in FIG. 8) is optimally relieved so that the twin levers can be reliably pivoted even for an extended period of use of the pressing tongs.

The pressing tongs as well as the actuating device 34 are otherwise of identical configuration as in the preceding embodiments. In particular, the levers connected to one another in an articulated way by the bolt 46 form a knee link (elbow joint) as described in an exemplary fashion in connection with FIGS. 1, 2, 5, and 6.

Figure 9:
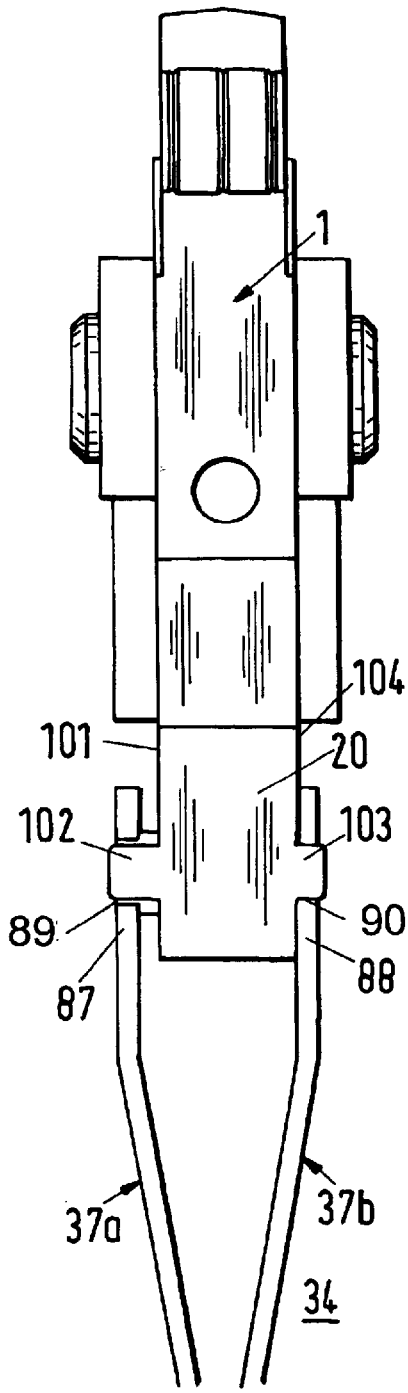
FIG. 9 is a side view of a fourth embodiment of the pressing tongs according to the invention.

FIG. 9 shows an embodiment in which the end portions 87, 88 of the twin levers 37*a*, 37*b* are provided with receptacles 32*a*, 32*b* in the form of openings. Two projections 102, 103 which are provided on the arms 20, 21 of the pressing jaws 1, 2 engage these receptacles. They (102, 103) project perpendicularly from the lateral surfaces 101, 104 of the arms. The projection 102 is longer than the projection 103 so that in the area between the lateral surface 101 of the arms 20 and the end of the end portion 87 projecting past the projection 102 the corresponding short leg of the adjacent lever can engage. Accordingly, the two twin levers 37*a*, 37*b*; 38*a*, 38*b* (FIG. 7) of the actuating device 34 can be articulated in the fashion of an elbow joint by means of the bolt 46 as has been explained in connection with the preceding embodiments in detail. The twin levers 37*a*, 37*b*; 38*a*, 38*b* are again formed as flat sheet metal parts. The parts of the oppositely positioned twin levers which project past the pipe or pipe members 44, 45 (FIG. 1) are elastically bendable (flexible) so that the pressing tongs can be connected simply by means of the projections 102, 103 with the actuating device 34. The projections 102,103 can be configured according to the projections 97, 98 of the embodiment according to FIG. 8. It is moreover possible to employ, instead of the openings 89, 90 in the end portions 87, 88 of the levers 37*a*, 37*b*, a connecting link guide that is open toward the edge so that the levers 37*a*, 37*b* can be simply pushed onto the projections 102,103 of the pressing tongs. In other respects, the pressing tongs are identical to the preceding embodiments.

The levers of the actuating device 34 can moreover be provided with end stops 105, 106 (FIG. 5) in all described embodiments in order to ensure a defined end position of the levers. The stops 105, 106 are advantageously a monolithic part of the levers 37, 38 and located on the free ends of the short legs 41,42. The stops 105, 106 project in direction toward the strap members 30, 31 past the short legs 41, 42 and will contact one another in the pressed-together end position of the levers 37, 38. The receptacles 32, 33; 32*a*, 32*b* are formed as monolithic parts of the pressing jaws 1, 2 in the described and illustrated embodiments, for example, in the form of openings, depressions, recesses, or projections. However, it is also possible to provide these receptacles as separate parts on the ends of the arms 20, 21 of the pressing tongs.

While specific embodiments of the invention have been shown and described in detail to illustrate the inventive principles, it will be understood that the invention may be embodied otherwise without departing from such principles.

What is claimed is:

1. A pressing device comprising:

pressing tongs having two pressing jaws, wherein at least one of the two pressing jaws is configured to be moved from a closed position into an open position;

the pressing tongs having at least one first connector configured to connect the pressing tongs to a motor-driven actuating device;

the pressing tongs having at least one second connector configured to connect the pressing tongs to a manual actuating device;

wherein the two pressing jaws are configured to be pivoted in opposite directions relative to one another by the manual actuating device;

two connecting straps articulating the two pressing jaws to one another;

wherein the two connecting straps are arranged on opposed sides of the pressing jaws;

wherein at least one of the two connecting straps is provided with the at least one first connector.

2. A pressing device comprising:

pressing tongs having two pressing jaws, wherein at least one of the two pressing jaws is configured to be moved from a closed position into an open position;

the pressing tongs having at least one first connector configured to connect the pressing tongs to a motor-driven actuating device;

the pressing tongs having at least one second connector configured to connect the pressing tongs to a manual actuating device;

wherein the two pressing jaws are configured to be pivoted in opposite directions relative to one another by the manual actuating device;

two connecting straps articulating the two pressing jaws to one another;

wherein the two connecting straps are arranged on opposed sides of the pressing jaws;

wherein at least one of the two connecting straps has at least one strap member projecting away from the at least one of the two connecting straps, wherein the at least one strap member is provided with the at least one first connector.

3. The pressing device according to claim 2, wherein the at least one first connector is an opening configured to receive a connecting element for connecting the pressing tongs to the motor-driven actuating device.

4. A pressing device comprising:

pressing tongs having two pressing jaws, wherein at least one of the two pressing jaws is configured to be moved from a closed position into an open position;

the pressing tongs having at least one first connector configured to connect the pressing tongs to a motor-driven actuating device;

the pressing tongs having at least one second connector configured to connect the pressing tongs to a manual actuating device;

wherein the two pressing jaws are configured to be pivoted in opposite directions relative to one another by the manual actuating device;

wherein at least one of the two pressing jaws is a two-armed lever, wherein the two-armed lever comprises a first lever arm having a recess configured to receive a part to be pressed;

wherein the two-armed lever comprises a second lever arm, wherein the at least one second connector is provided on the second lever arm;

wherein the at least one first connector and the at least one second connector are spaced apart at a distance from one another;

wherein the at least one first connector is spaced at a first distance from the recess and the at least one second connector is spaced at a second distance from the recess, wherein the second distance is greater than the first distance.

5. The pressing device according to claim 4, wherein the at least one second connector is provided proximal to the free end of the second lever arm.

6. A pressing device comprising:

pressing tongs having at least two pressing jaws, wherein at least one of the at least two pressing jaws is configured to be moved from a closed position into an open position;

the pressing tongs having at least one first connector configured to connect the pressing tongs to a motor-driven actuating device;

the pressing tongs having at least one second connector configured to connect the pressing tongs to a manual actuating device;

a manual actuating device comprising two fevers pivotable relative to one another in opposite directions, wherein the two levers are configured to be connected to the at least two pressing jaws.

7. The pressing device according to claim 6, wherein the two levers and the at least two pressing jaws pivot in opposite directions.

8. The pressing device according to claim 7, wherein the two levers are L-shaped.

9. The pressing device according to claim 8, wherein each one of the two levers has a short leg and a long leg, wherein the short legs are articulated to one another on an articulation axis.

10. The pressing device according to claim 9, wherein the articulation axis is positioned between a first one and a second one of the at least one second connector.

11. The pressing device according to claim 9, wherein several of the at least one second connector are positioned in a plane, wherein the articulation axis in the closed position of the at least two pressing jaws is positioned on a side of the plane facing away from the levers.

12. The pressing device according to claim 6, wherein the levers form a part of an elbow lever.

13. The pressing device according to claim 9, wherein at least the short legs of the levers are located within a thickness of the at least two pressing jaws.

14. The pressing device according to claim 6, wherein each one of the levers is comprised of twin levers.

15. The pressing device according to claim 14, wherein the twin levers are positioned at least with a portion of a length of the twin levers on opposed sides of the pressing jaws.

16. The pressing device according to claim 6, wherein the levers are flat sheet metal parts.

17. The pressing device according to claim 6, wherein the levers are cast parts or forged parts.

18. The pressing device according to claim 6, further comprising a grip member wherein the levers are received in the grip member.

19. The pressing device according to claim 18, wherein the grip member is a pipe or pipe section.

20. The pressing device according to claim 9, wherein the long legs have a width increasing in a direction toward the short legs.

21. The pressing device according to claim 14, wherein at least one of the twin levers is at least partially elastically yielding.

22. The pressing device according to claim 21, wherein each one of the twin levers has a short leg and a long leg, wherein at least the long leg of a lever arm is at least partially elastically bendable.

23. The pressing device according to claim 22, further comprising a grip member, wherein the twin levers are received in the grip member, wherein the long legs of the twin levers have first end portions arranged within the grip member and resting against one another in the grip member.

24. The pressing device according to claim 23, wherein the first end portions are planar.

25. The pressing device according to claim 23, wherein the long legs of the twin levers have slanted portions connected to the first end portions and diverging away from the first end portions.

26. The pressing device according to claim 25, wherein the long legs of the twin levers further comprise second end portions adjoining the slanted portions, wherein the second end portions are configured to connect the twin levers to the at least two pressing jaws.

27. The pressing device according to claim 26, wherein the second end portions are parallel to one another.

28. The pressing device according to claim 26, further comprising at least one coupling member, wherein the second end portions have openings configured to receive the at least one coupling member.

29. The pressing device according to claim 28, wherein the at least one coupling member is a socket pin or a threaded pin.

30. The pressing device according to claim 6, wherein the at least one second connector is at least one depression in the at least two pressing jaws.

31. The pressing device according to claim 30, wherein the levers have at least one projection engaging the at least one depression.

32. The pressing device according to claim 6, wherein the at least one second connector is at least one projection on the at least two pressing jaws.

33. The pressing device according to claim 32, wherein the levers have at least one opening engaging the at least one projection.

34. The pressing device according to claim 6, wherein the levers comprise at least one stop for limiting the pivot path of the levers.

35. The pressing device according to claim 34, wherein at least one of the levers has the at least one stop.

36. The pressing device according to claim 34, wherein the at least one stop has correlated therewith at least one counter stop.

37. The pressing device according to claim 36, comprising at least one connecting strap articulating the at least two pressing jaws, wherein at least one of the two connecting straps has at least one strap member projecting away from the at least one of the two connecting straps, wherein the counter stop is formed by the at least one strap member.

38. A pressing device comprising:

pressing tongs having at least two pressing jaws wherein at least one of the at least two pressing jaws is configured to be moved from a closed position into an open position;

the pressing tongs having at least one first connector configured to connect the pressing tongs to a motor-driven actuating device;

the pressing tongs having at least one second connector configured to connect the pressing tongs to a manual actuating device;

wherein the at least two pressing jaws have arms provided with facing surfaces;

a motor-driven actuating device comprising pressing rollers mounted on a plunger and interacting with the facing surfaces;

wherein the plunger is moved outwardly from the motor-driven actuating device when closing the pressing device and the pressing rollers push the facing surfaces apart for press-jointing parts received in the pressing device.

* * * * *